US007140473B2

(12) United States Patent
Det et al.

(10) Patent No.: US 7,140,473 B2
(45) Date of Patent: Nov. 28, 2006

(54) SAFETY TOP BALUSTRADE FOR A CAR OF A MACHINE ROOM-LESS ELEVATOR

(75) Inventors: Franck Det, Saint Martin sur Ocre (FR); Franck Dominguez, Saint Denis en Val (FR)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/517,725

(22) PCT Filed: Jun. 20, 2002

(86) PCT No.: PCT/IB02/02292

§ 371 (c)(1),
(2), (4) Date: Dec. 10, 2004

(87) PCT Pub. No.: WO04/000713

PCT Pub. Date: Dec. 31, 2003

(65) Prior Publication Data

US 2005/0252726 A1 Nov. 17, 2005

(51) Int. Cl.
*B66B 11/02* (2006.01)

(52) U.S. Cl. ..... 187/401

(58) Field of Classification Search ..... 187/401, 187/408; 182/113; 14/43
See application file for complete search history.

(56) References Cited

U.S. PATENT DOCUMENTS 577,443 A * 2/1897 Morse et al. ..... 14/43
4,557,353 A * 12/1985 Pichon ..... 187/239
5,170,746 A * 12/1992 Roose ..... 119/512
5,683,074 A * 11/1997 Purvis et al. ..... 256/67
6,202,801 B1 * 3/2001 Muller et al. ..... 187/401
6,230,845 B1 * 5/2001 Yamakawa et al. ..... 187/391
6,543,584 B1 * 4/2003 Miyakoshi et al. ..... 187/401

FOREIGN PATENT DOCUMENTS

| | | | |
|---|---|---|---|
| EP | 0985628 A | | 3/2000 |
| JP | 02291377 A | * | 12/1990 |
| JP | 03120183 A | * | 5/1991 |
| JP | 05330752 A | * | 12/1993 |
| JP | 06032555 A | * | 2/1994 |
| JP | 2001 341950 | | 12/2001 |
| JP | 2002 128433 | | 5/2002 |

* cited by examiner

*Primary Examiner*—Kathy Matecki
*Assistant Examiner*—Eric E. Pico

(57) ABSTRACT

Safety top balustrade for a car of a machine room-less elevator which moves in a hoistway, on a wall of which the controller of the elevator is secured, said balustrade comprising:—a fixed structure (21) comprising a plurality of vertical uprights (24) fixed at intervals near edge of the car roof (16) and at least two horizontal tubular guard rails (20, 30) fixed at different heights on the uprights, around the periphery of the car roof, except at the place which is in front of the controller (14) when the car is at the level of controller, in order to leave a passage (33) for direct access to the latter,—a mobile structure (34) comprising at least two horizontal bars (36, 38) which are telescopically mounted inside the tubular guard rails, so as to slide between an open position where the bars are inserted within the guard rails, to free said passage towards the controller, and a closed position where the bars are extended out of the guard rails, whereby said passage is obstructed.

5 Claims, 1 Drawing Sheet

SAFETY TOP BALUSTRADE FOR A CAR OF A MACHINE ROOM-LESS ELEVATOR

FIELD OF THE INVENTION

This invention concerns a safety balustrade mounted on the roof of a car of a machine room-less elevator.

TECHNICAL BACKGROUND

In modern elevator installations, the tendency is to reduce as much as possible the ground surface and the height occupied by the installation. One of the solutions found to reach this aim is to eliminate the machine room which, till now, was located either at the top or at the bottom of the hoistway or else in a lateral local of the hoistway, and to secure the control equipment, for instance the controller, on a wall of the hoistway. Nowadays, it is well known to manufacture machines and controllers having a small thickness, which can then be secured in the space comprised between the hoistway and the car.

In the elevators of this kind, a balustrade is generally provided on the roof of the car, in a position somewhat offset from the edge of the roof to prevent any risk of falling into the hoistway when the roof is not at the level of the controller.

When a technician had to intervene on the controller or on the machine to effect maintenance or reparation operations, he has to climb onto the roof, to control the motion of the car and to stop it when the controller is within easy reach. Since the controller protrudes with respect to the wall of the hoistway, it arrives sufficiently near to the car to eliminate any risk of falling in the hoistway.

However, the technician had to work through the bars of the balustrade, or over the balustrade, i.e. at distance from the controller. In this position, certain working operations become rapidly uncomfortable and tiring. Furthermore, since the balustrade must be made of steel to guarantee sufficient resistance, its interposition between the technician and the controller increases the risk of electrical shock during operations made on electrical components.

SUMMARY OF THE INVENTION

The object of this invention is to solve these problems. To this end, the invention provides a safety top balustrade for a car of a machine room-less elevator which moves in a hoistway, on a wall of which the controller of the elevator is secured, said balustrade comprising:

- a fixed structure comprising a plurality of vertical uprights fixed at intervals near the edge of the car roof, and at least two horizontal tubular guard rails fixed at different heights on the uprights, around the periphery of the car roof, except at the place which is in front of the controller when the car is at the level of the controller, in order to leave a passage for direct access to the latter,
- a mobile structure comprising at least two horizontal bars which are telescopically mounted inside the tubular guard rails, so as to slide between an open position where the bars are inserted within the guard rails, to free said passage towards the controller, and a closed position where the bars are extended out of the guard rails, whereby said passage is obstructed.

The mobile structure is maintained in its closed position whenever the roof is not at the level of the controller and is brought to its open position only when the car stops at this level. In this position, there is no danger of falling because the controller is in close proximity to the edge of the car roof. However, in order to increase the security of the technician, and to allow him to approach closer to the controller, the roof of the car can be equipped with a bridge, comprised of a simple plate slidingly mounted on the car roof between a retracted position and an extended position in which a part of its length protrudes from the car roof over the space comprised between the car and the wall of the hoistway.

In its extended position, the end of the bridge can lie on a support bracket secured to the controller or to the wall of the hoistway.

The bars of the mobile structure can be independent and then they must be moved independently from their open position to their closed position and vice versa. In a more advantageous embodiment, the bars are connected at their outer ends by a vertical cross bar so that they can be integrally moved. The cross bar also acts as an abutting element which limits the movement of the mobile structure in its open position.

The mobile structure can be secured in either its retracted and open positions by means of locking elements, such as pins or bolts, which pass through holes drilled in the guard rails and in the bars. The mobile structure is then prevented to slide accidentally.

BRIEF DESCRIPTION OF THE DRAWINGS

An embodiment of the invention will be now described with reference to the enclosed drawing in which.

DETAILED DESCRIPTION OF THE PREFERRED EMBODIMENT

Figure 1:
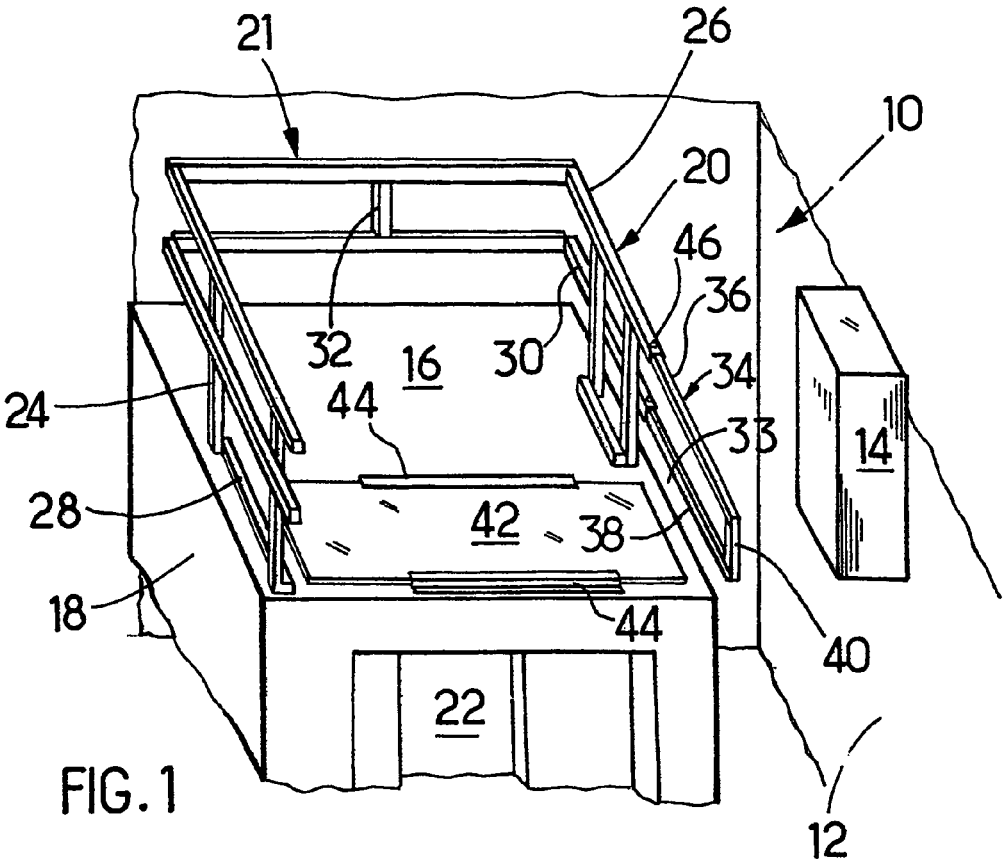
FIG. 1 shows a partial perspective view of an elevator car equipped with a balustrade according to the invention, the mobile structure of the balustrade being shown in the extended open position and the bridge in the retracted position.
Figure 2:
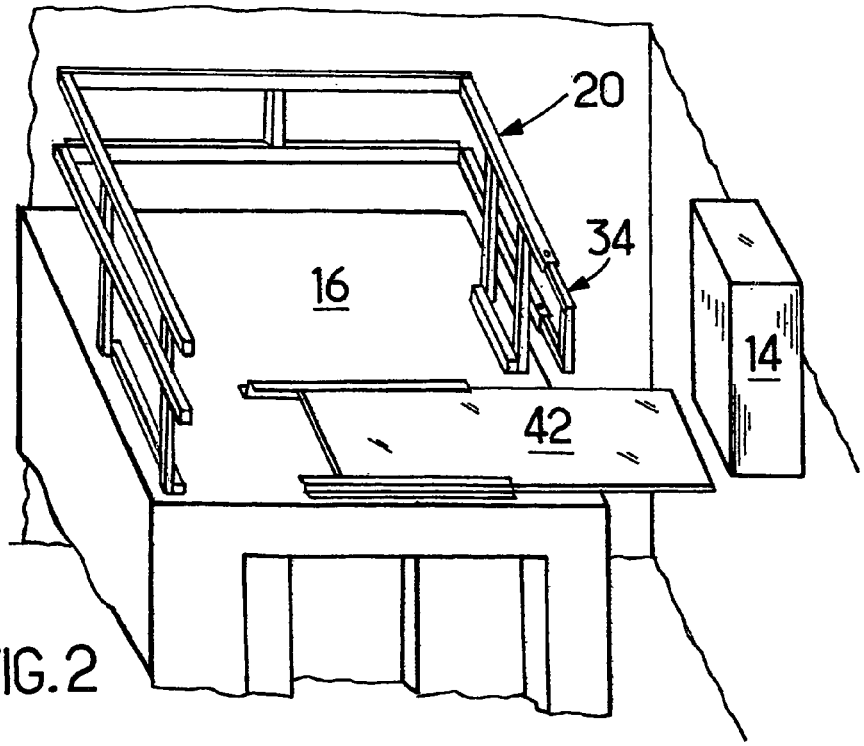
FIG. 2 is a perspective view similar to FIG. 1, and shows the mobile structure in the retracted position and the bridge in the extended position.

The elevator installation 10 shown in the drawings is of the type machine room-less. The controller 14 of the elevator is fixed to a wall 12 of the hoistway in which the car 18 moves.

The interventions on the controller are made from the roof 16 of the car 18. The roof is equipped with a balustrade 20 which surrounds the roof, except along the edge of the roof which is adjacent to the front wall of the car, not shown, in which the car door 22 is located. The balustrade is not necessary on this side because the interval between said front wall of the hoistway is very little, and therefore there is no danger of falling.

The balustrade 20 comprises a fixed structure 21 comprising a plurality of vertical uprights 24 fixed near the periphery of the roof, and at least two horizontal tubular guard rails 26, 30 fixed at the top and at half-height of the vertical uprights respectively.

Each guard rail is U-shaped and comprises three tubes made of steel and having substantially the same lengths as the edges of the roof respectively. The tubes of each guard rail are fixed to each other by welding, screwing or the like. Said tubes have preferably a square cross section.

In the drawings, there are uprights 24 along the left and right edges of the roof, but not along the rear edge, and the tubes of the guard rails extending along said rear edge are connected therebetween by a strut 32. Of course, uprights can also be mounted on the rear edge of the roof.

Preferably, the upper guard rail 26 is fixed on the uprights at waist height.

According to the invention, the fixed structure 21 is interrupted on its right side in FIG. 1, at the place which having a width is in front of the controller 14, thereby leaving a free passage 33 having a width which corresponds substantially to the width of the controller. This passage can be closed by a mobile structure 34 comprising at least two bars 36, 38 which are telescopically inserted within the ends of the tubular guard rails 26, 30. The bars 36, 38 are made of steel and have a square cross section. They are connected to each other at their ends by a vertical cross bar 40 whereby they can slide integrally. Said cross bar acts also as an abutting element which stops the mobile structure when it is completely open.

According to an advantageous embodiment of the invention, a foot-bridge 42 is slidingly mounted on the roof of the car, along guides 44 extending in a direction transversal to the passage 33.

FIG. 1 shows the normal position of the balustrade in which the technician finds it when he climbs onto the roof: the mobile structure 34 is extended and obstructs the passage 33, while the bridge 42 is retracted and lies completely on the roof 16. After the technician has moved the car until the level of the controller, he drives the mobile structure 34 leftward on FIG. 1 to free the passage 33, and then he draws the bridge 42 out of the roof. The presence of the bridge prevents small objects, such as screws and bolts, from falling in the hoistway.

Increased stability can be provided for the portion of the bridge which protrudes from the roof if its end lies on a support bracket, not illustrated, fixed to the hoistway or on the controller.

The mobile structure 34 can be secured in its retracted position or in its extended position, by means of pins or bolts 46 inserted through holes drilled in the guard rails 26, 30 and in the bars 36, 38.

The invention claimed is:

1. Safety top balustrade for a car of a machine room-less elevator which moves in a hoistway, on a wall of which a controller of the elevator is secured, said balustrade comprising:

a fixed structure comprising a plurality of vertical uprights located at intervals near the edge of a car roof and at least two guard rails fixed at different heights on the uprights, the fixed structure located around at least a portion of the periphery of the car roof, a mobile structure comprising at least two bars that are telescopically mounted inside the guard rails, so as to slide between an open position where the bars are inserted within the guard rails, and a closed position where the bars are extended out of the guard rails, wherein the mobile structure is positioned along the edge of the car roof so as to allow access to the controller mounted in the hoistway.

2. Balustrade according to claim 1, wherein a bridge comprising a horizontal plate is slidingly mounted on the roof of the car between a retracted position in which it is placed completely on the roof, and an extended position in which a portion of the bridge protrudes outside of the roof across the space between the car and the wall of the hoistway so as to allow access to the controller mounted in the hoistway.

3. Balustrade according to claim 1, wherein the bars of the mobile structure are connected at their ends by a cross bar that acts as an abutting element and which allows the mobile structure to be moved integrally.

4. Balustrade according to claim 1, wherein the mobile structure is secured in its retracted position or in its extended position by means of locking elements inserted through holes drilled in the guard rails and the bars.

5. Balustrade according to one of the preceding claims, wherein the guard rails and the bars have a square section and are made of steel.

* * * * *